US011077353B1

(12) United States Patent
Kamstra et al.

(10) Patent No.: US 11,077,353 B1
(45) Date of Patent: Aug. 3, 2021

(54) THROWING APPARATUS

(71) Applicant: G Master, LLC, West Chester, OH (US)

(72) Inventors: Garrett A. Kamstra, North Bend, OH (US); Frank Joseph Hood, Sioux Falls, SD (US)

(73) Assignee: G Master, LLC, West Chester, OH (US)

( * ) Notice: Subject to any disclaimer, the term of this patent is extended or adjusted under 35 U.S.C. 154(b) by 0 days.

(21) Appl. No.: 16/748,231

(22) Filed: Jan. 21, 2020

Related U.S. Application Data

(60) Provisional application No. 62/795,154, filed on Jan. 22, 2019.

(51) Int. Cl.
*A63B 69/40* (2006.01)
*F41B 3/03* (2006.01)

(52) U.S. Cl.
CPC ..... *A63B 69/407* (2013.01); *F41B 3/03* (2013.01)

(58) Field of Classification Search
CPC ..... A63B 69/40; A63B 69/407; A63B 69/408; F41B 3/00; F41B 3/03
USPC ..... 124/7
See application file for complete search history.

(56) References Cited

U.S. PATENT DOCUMENTS 1,162,910 A * 12/1915 Goude ..... A63B 69/408 124/7
1,912,360 A * 6/1933 Blanchard ..... A63B 69/408 124/7
2,696,204 A * 12/1954 Gilgoff ..... F41B 3/03 124/7
3,552,371 A * 1/1971 Kahelin ..... F41J 9/20 124/7
3,722,494 A * 3/1973 Slevin ..... A63B 69/408 124/7
4,844,045 A * 7/1989 Powell ..... A63B 69/408 124/7
4,860,717 A * 8/1989 Powell ..... A63B 69/408 124/7
4,906,001 A * 3/1990 Vaughn ..... A63B 69/0075 124/36
5,660,386 A * 8/1997 Krieger ..... A63B 69/407 124/7
6,129,076 A * 10/2000 Powell ..... A63B 69/408 124/36
7,066,846 B2 * 6/2006 Horkan ..... A63B 69/002 124/7
7,415,976 B1 * 8/2008 Powell ..... F41B 3/04 124/16
10,603,568 B2 * 3/2020 Palanethra ..... F41B 3/03
2004/0020481 A1 * 2/2004 Keller ..... F41B 3/04 124/6
2010/0307470 A1 * 12/2010 Mihaljevic ..... F41B 3/03 124/7
2013/0333679 A1 * 12/2013 Kroll ..... F41B 3/03 124/7

(Continued)

*Primary Examiner* — Alexander R Niconovich
(74) *Attorney, Agent, or Firm* — Middleton Reutlinger

(57) ABSTRACT

A throwing apparatus and method for throwing objects are provided. More specifically, the throwing apparatus features improved arrangement of bearing assembly and location of movable parts which stabilize and improve the performance and accuracy of a throwing apparatus. A throwing arm lever and throwing arm are offset from one another with the bearing assembly disposed therebetween.

14 Claims, 7 Drawing Sheets

(56) References Cited

U.S. PATENT DOCUMENTS

2016/0250536 A1* 9/2016 Hart ..... A63B 69/40
124/7

* cited by examiner

100

| SPEED MPH | MACRO ADJUSTMENT | MICRO ADJUSTMENT | SPRING ADJUSTMENT | DISTANCE FEET |
|---|---|---|---|---|
| 52 | 3 | 4 | 13 | 40-56 |
| 48 | 3 | 4 | 12 | 40-54 |
| 46 | 3 | 3 | 12 | 40-50 |
| 44 | 3 | 3 | 11 | 40-50 |
| 42 | 3 | 3 | 10 | 40-50 |
| 40 | 3 | 3 | 9 | 40-50 |
| 38 | 3 | 3 | 8 | 40-50 |
| 36 | 3 | 3 | 7 | 35-40 |
| 34 | 3 | 3 | 6 | 35-40 |
| 32 | 3 | 3 | 5 | 30-40 |
| 30 | 3 | 3 | 4 | 30-40 |
| 28 | 3 | 3 | 3 | 30-35 |
| 26 | 3 | 3 | 2 | 30-35 |
| 24 | 3 | 2 | 2 | 25-30 |

BASEBALL

*FIG. 7*

THROWING APPARATUS

PRIORITY APPLICATION

This non-provisional patent application claims priority to and benefit of, under 35 U.S.C. § 119(e), U.S. Provisional Patent Application Ser. No. 62/795,154, filed Jan. 22, 2019 and titled "Throwing Apparatus", all of which is incorporated by reference herein.

BACKGROUND

1. Field of the Invention

Present embodiments relate to a throwing apparatus and method for throwing objects. More specifically, the present embodiments relate to features which stabilize and improve the performance and accuracy of a throwing apparatus.

2. Description of the Related Art

Various types of throwing apparatuses are available as practice devices for athletics. These may be used with basketball, football, and baseball for example. Many of these type of devices require electrical connection to power rotating wheels to fire or shoot balls to the user, in an effort to aid in repetitive actions of catching.

One problem with such devices is that they require electricity, which is not always available on the playing surface of the practice or game field. Another issue is that the rotating wheels which propel the balls, sometimes impart spin which differs from game situations. Still further, these devices can be expensive and may also be difficult to adjust.

Manual devices are known which remove the necessity for providing electricity to the pitcher's mound. However, these mechanical devices may be complicated to use, large in size, and may obstruct the field of play when set up. Current designs require more physical strength and leverage and it would be desirable to reduce resistance and therefore provide an easier to use throwing apparatus.

Thus, it would be desirable to provide a compact, stable, accurate and easily adjustable throwing apparatus, which is capable of accurately throwing a variety of balls simply and inexpensively. It would also be desirable to provide an improved throwing apparatus and method for throwing objects, such as baseballs, accurately, and which can be easily adjusted to vary the location of the ball as it crosses the plate.

The information included in this Background section of the specification, including any references cited herein and any description or discussion thereof, is included for technical reference purposes only and is not to be regarded subject matter by which the scope of the invention is to be bound.

SUMMARY

Accordingly, a throwing mechanism is provided which provides a stable base having a foot pedal connected thereto. The pedal may be depressed to energize a throwing arm motion. A bearing assembly is provided for pivotally supporting a throwing arm. A handle is provided on a release arm which is pivotally connected to a release mount. A spring is adjustably mounted at one end to a leg and to power the system in an adjustable manner and the spring is connected at an opposite end to a throwing arm lever, operably connected to the throwing arm.

According to some embodiments, a throwing apparatus may comprise a base having a forward end and a rearward end, a transverse support member extending across the base, and, an axle arm mount extending from said base. A throwing arm lever may be disposed along one side of said axle arm mount and a throwing arm may be disposed on a second side of the axle arm mount. A sleeve disposed on said arm axle mount, an axle extending through the sleeve and supported by a bearing assembly, the axle operably connected to the throwing arm lever and the throwing arm. A spring extending from the throwing arm lever to a leg.

According to some optional embodiments, any of the following additional features may be used alone or in combination with one another. The leg being pivotally connected to the base. One end of the spring may be adjustable relative to the leg. The base may further comprise a foot at one end of the base. The throwing apparatus may further comprise a mounting block operably connected to the throwing arm. The mounting block may be operably connected to the axle. The throwing arm may have a first surface and a second surface angled relative to the first surface. The throwing arm may have a plurality of adjustment apertures. The throwing apparatus may further comprise a release arm having a handle. The throwing apparatus may further comprise a release arm having a release finger with control guides. The throwing apparatus may further comprise an angled surface disposed between said control guides. The leg may further comprise a foot pedal at an end thereof.

According to some embodiments, a throwing apparatus may comprise a base having a forward end and a rearward end, a transverse cross-member at one of the forward end or the rearward end extending across the base, an axle arm mount extending above the base, a throwing arm lever disposed along one side of the axle arm mount, a throwing arm disposed on a second side of the axle arm mount, a sleeve disposed on the axle arm mount and oriented horizontally, an axle extending through said sleeve and supported within said sleeve by a bearing assembly, said axle operably connected to said throwing arm lever and said throwing arm, a spring extending from the throwing arm lever to a leg, the leg pivotally connected to said base, and, a release which retains or releases the throwing arm from a cocked position to throw a ball.

According to some embodiments a throwing apparatus may comprise a base having a forward end and a rearward end, a cross-member at one of the forward end or the rearward end extending across the base, a sleeve elevated from the base and positioned on an axle arm mount extending above the base, the sleeve oriented horizontally, an axle extending through the sleeve and supported by a bearing assembly, the axle operably connected to a throwing arm lever near one end of said axle and a throwing arm near a second end of said axle, a spring extending from the throwing arm lever to a leg, the leg pivotally connected to the base, and, a release which retains or releases the throwing arm from a cocked position to throw a ball.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments may be better understood, embodiments of a throwing apparatus will now be described by way of examples. These embodiments are not to limit the scope of the claims as other embodiments of a throwing apparatus will become apparent to one having ordinary skill in the art upon reading the instant description. Non-limiting examples of the present embodiments are shown in figures wherein:

FIG. 7 is a speed and distance chart illustrating the variety of speeds and distances obtainable through simple adjustments of the invention shown in FIG. 1.

DETAILED DESCRIPTION

Figure 1:
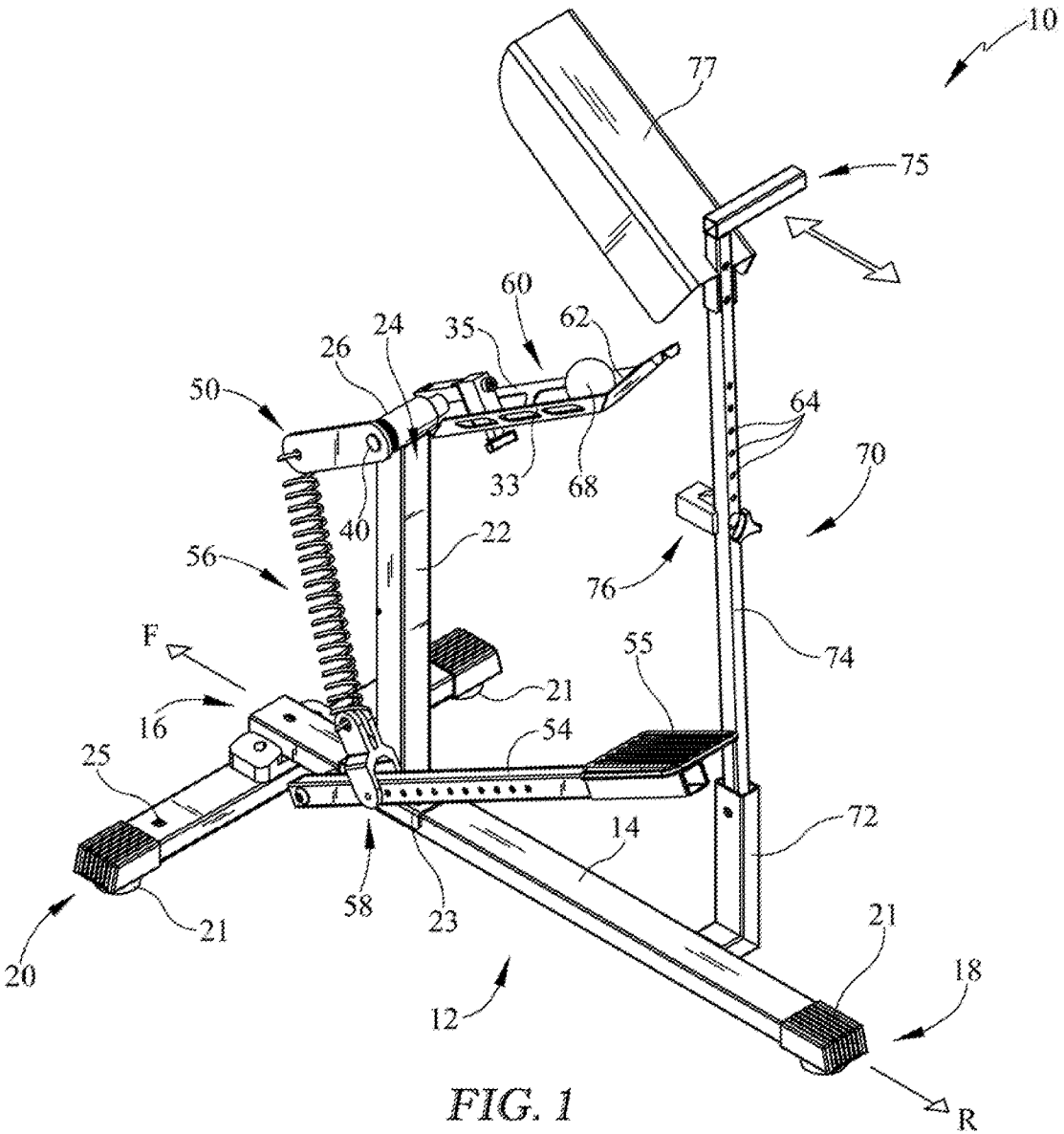
FIG. 1 is a perspective view of an embodiment of a throwing mechanism shown in an uncocked position.

It is to be understood that a throwing apparatus is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

With reference to FIGS. 1-7, present embodiments provide a throwing mechanism for use with a ball wherein the throwing mechanism comprises a base having a throwing arm mount and a low friction bearing assembly positioned thereon. A throwing arm lever provides a structure for applying torque to a throwing arm and the ball bearing assembly allows for more efficient use of spring force. A leg is provided which allows for adjustable positioning of a spring in order to vary throwing force of the throwing arm. The throwing mechanism reduces friction and increases force through leverage, the bearing assembly and weight reduction.

With reference now to FIG. 1, a perspective view of the throwing machine 10 is provided in an uncocked position. The throwing machine includes a base 12 which may be defined by one or more members. In the instant embodiment, the base 12 comprises a longitudinal base member 14. The base member 14 has a forward end 16, toward the direction of a thrown ball 68 (FIG. 2), and a rearward end 18, away from the direction of a thrown ball. According to the instant embodiment, the base 12 may also comprise at least one stabilizing cross-member 20. In the instant embodiment, the stabilizing cross member 20 is disposed toward the forward end 16 of the base member 14. Optionally, additional stabilizing members may be utilized. Further, the ends of the cross-members 20 may include feet or pads 21, and likewise the base 12 may also include such to add stability to the throwing machine 10. Still further, the cross member 20 may also include stake holes 25 to drive stakes through the cross members 20 into the ground or substrate G (FIG. 3) and additionally aid in stabilizing the throwing machine 10.

Extending from the base 12 is an axle arm mount 22. The axle arm mount 22 extends vertically but may have other non-vertical configurations. An upper end 24 of the axle arm mount 22, or adjacent thereto, provides a location for positioning of a sleeve 26 with a bearing assembly 30 (FIG. 6) therein. The axle arm mount 22 may be integrally formed with the base 12 or may be connected in a number of manners, including but not limited to fastened, welding, adhering, or other manners. In some embodiments, a plate 23 may be provided at the bottom of the axle arm mount 22 to bolt to the base 12. The plate 23 may be flat or may be U-shaped, as depicted, to extend about edges of the base 12. Other connection structures may be used as well. The plate 23 may be fastened, welded or otherwise removably or permanently connected to the base member 14.

The bearing assembly 30 (FIG. 6) rotatably supports an axle 40 which extends in a direction generally perpendicular to the forward-rearward direction of the throwing machine 10. The bearing assembly 30 supports rotatable motion of the axle 40 so that the throwing arm 60 may throw a ball. The bearing assembly 30 also reduces friction and resistance during movement to the throwing arm 60, resulting in improved performance when throwing a ball. On one side of the sleeve 26 and the axle arm mount 22 is a throwing arm lever 50. On the opposite side of the sleeve 26 and the axle arm mount 22 is a throwing arm 60. The throwing arm lever 50 may be biased to rotate and is operably connected the throwing arm 60 to create leverage for throwing arm 60 rotation. In the depicted embodiment, the throwing arm lever 50 is parallel to the throwing arm 60, but in other embodiments, the lever 50 may be angled relative to the throwing arm 60.

A leg 54 is connected to the base 12 which functions as a power lever. The leg 54 pivots relative to the base 12. The leg 54 may be pivotally connected to the base 12 near a forward end of the leg 54 and comprise a pedal 55 near an opposite end. The pedal 55 is normally pivoted toward an upper position when the throwing arm 60 is locked. The leg 54 is connected to a spring 56 at one end of the spring 56. The opposite end of the spring 56 is connected to the throwing arm lever 50. The pedal 55 may be depressed to stretch the spring 56 and energize the system. The term "spring" is used and may be defined by any resilient stretch-able material. The use of the foot pedal eliminates the need for electricity at the area where the throwing machine 10 is utilized.

At an end of the throwing arm 60, opposite the axle arm mount 22, there is a release 70. The release 70 is movable between a first position, which engages the throwing arm 60 and a second position wherein the release 70 is disengaged from the throwing arm 60. With the release 70 in the first position, the throwing arm 60 is retained from movement. Thus, with the throwing arm 60 retained, the pedal 55 may be depressed to stretch the spring 56 and provide power to the system to throw a ball.

The release 70 may comprise a mount 72 which extends from the base 12. The mount 72 may be fixed in some embodiments and receives a release bar 74. The release bar 74 may also include a handle 75 near an upper end for a user to grasp. The release bar 74 may pivot relative to the mount 72 to engage or disengage the throwing arm 60. The release bar 74 may further include a release handle 75, for example of contemporary design conformed to the fingers of a hand for ease and comfort of gripping. The handle 75 may be made of metal, rubber, plastic, any other suitable material, or combination of materials.

Figure 2:
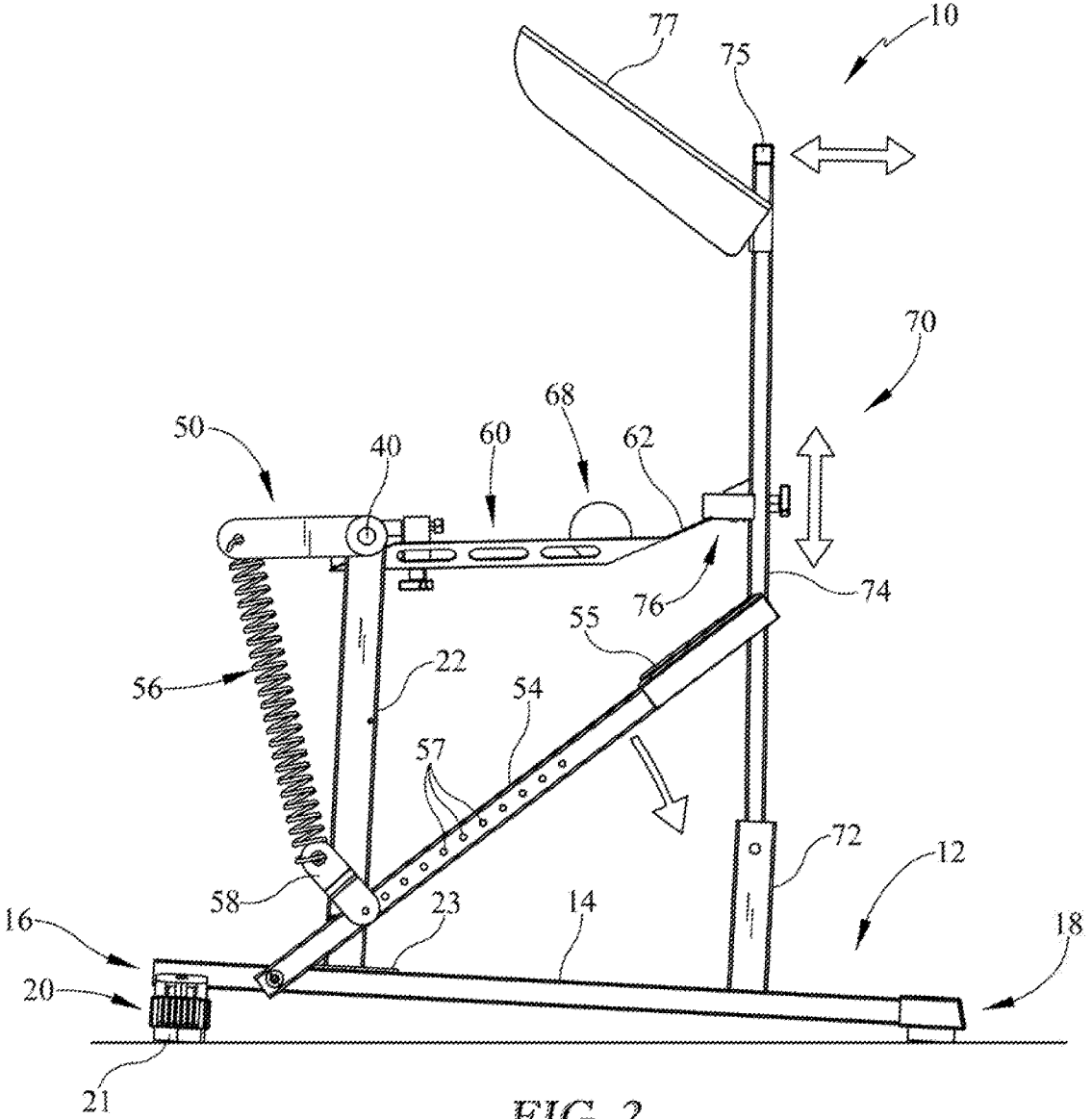
FIG. 2 is a first sequence view of an embodiment of the throwing mechanism with the arm shown in a cocked position.

Referring now to FIG. 2, the throwing arm 60 is shown moving toward a cocked position ready to release and throw the ball 68. In this position, the throwing arm 60 is retained by the release 70 such that the arm 60 cannot move until the handle 75 is pulled rearward. The pedal 55 is not depressed but is ready to be moved, in order to load the spring. Accordingly, the throwing arm 60 may not rotate relative to the sleeve 26 when the handle 75 captures the throwing arm 60.

Figure 3:
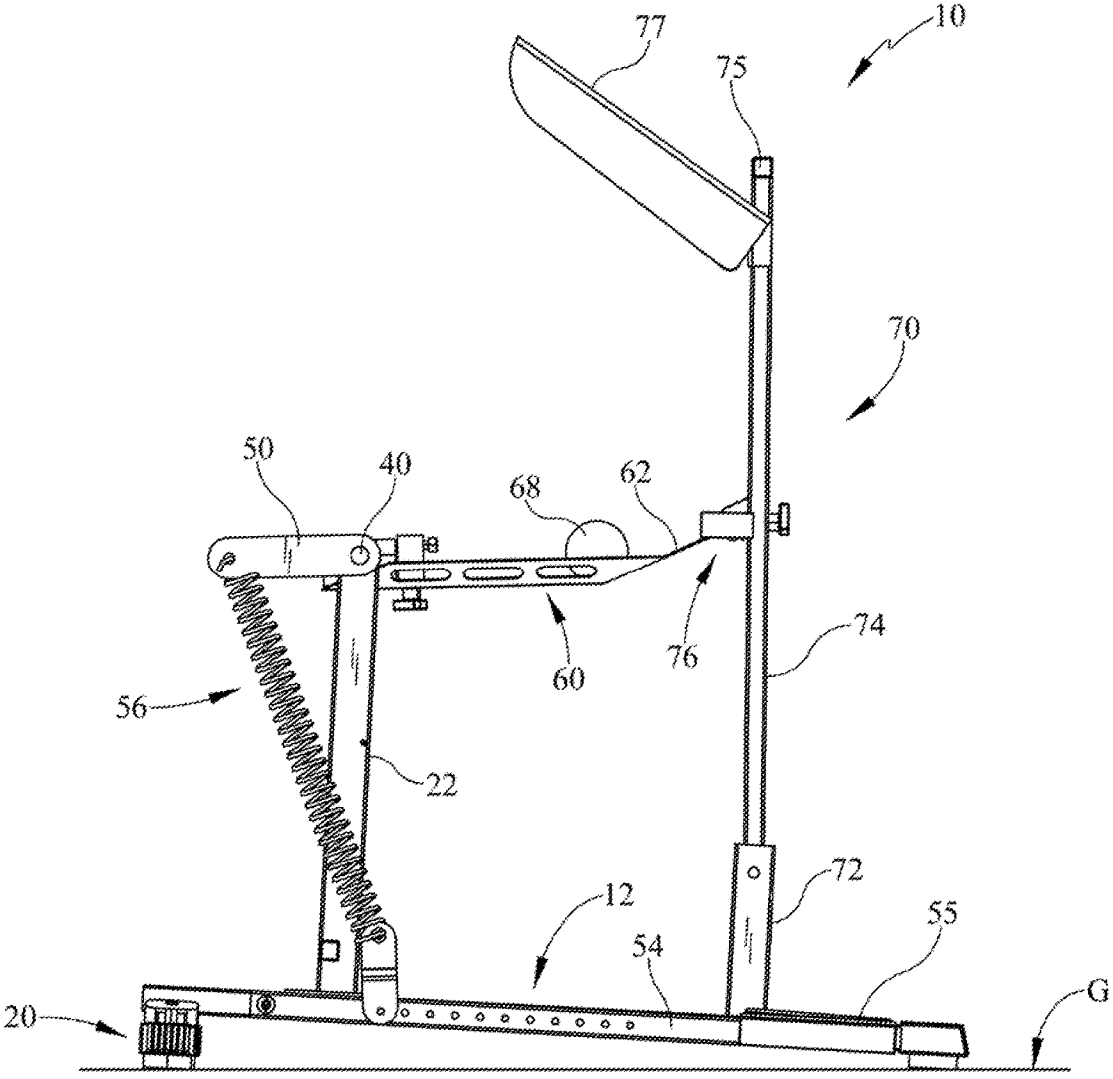
FIG. 3 is a second sequence view of an embodiment of the throwing mechanism with the pedal depressed to the spring arm.

With reference to FIG. 3, when the throwing arm 60 is retained from movement, the pedal 55 may be depressed as shown. As a result, the spring 56 is stretched due to the movement of the pedal 55 and retained condition of the throwing arm lever 50. The stretching of the spring 56 creates a potential force for the throwing arm 60 due to the operable connection and rotatable support of the lever 50 and throwing arm 60 within the sleeve 26 (FIG. 1). From the position depicted, the release 70 may be moved to release the spring force and allow rotation of the throwing arm 60. In turn, the ball 68 may be thrown.

In these views, the throwing arm 60 is better shown for purpose of description. The throwing arm 60 may comprise various lengths, shapes and cross sections. The throwing arm 60 may be formed of various rigid materials including, but not limited to, non-parallel flat surfaced ridged materials, such as aluminum, iron, rigid PVC, or the like. In some embodiments, the throwing arm 60 has a top surface, a bottom surface and a generally V-shaped cross section. The throwing arm 60 may be formed in various shapes and in some embodiments, may be a rectangular shaped elongated flat section which is folded so as to form a "V" or a "U" shaped cross-section, into which an object such as a ball may be placed. In other embodiments, the V-shape may be formed by joining two flat planar members. In some embodiments, the two surfaces of the throwing arm 60 may create a 90° angle. The throwing arm 60 may also have at least one aperture formed therein to reduce weight and/or define a seat for a ball positioned therein.

The throwing arm 60, in the position depicted, extends generally in a forward F rearward R direction. At the rearward end of the throwing arm 60, the release 70 also includes a release finger or block 76. The release block 76 varies the release position of the ball being thrown and may be used to make macro height adjustments for the ball being thrown. For example, to raise or lower the height of the ball from ground balls to pitches. The adjacent edge of the throwing arm 60 includes a tapered portion 62 which may form a point or may have a flattened edge. The tapered portion 62 engages the release finger 76 along a bottom edge, a bottom surface, or a combination, for example, in order to hold the throwing arm 60 in a retained position shown in FIG. 2, or release the throwing arm 60, as shown further herein.

The release finger 76 is shown adjustably positioned on a release bar 74. The release bar 74 may include a plurality of adjustment apertures 64 (FIG. 1) so that the release finger 76 may be moveable along the axial direction of the bar 74. The positional adjustment of the release finger 76 allows for different retaining positions of the arm 60 and different release positions for the ball 68 to control the height of the ball throw. The release finger 76 may be movably connected through pitch height adjustment apertures 64 by various structures known in the art such as bolts and wing nuts, or any fastener and adjustment knob, as depicted. Other fastening structures may be utilized. The release finger 76 may be adjusted by a threaded fastener which may be threadably adjusted into or out of the apertures 64 of the bar 74, or alternatively a spring loaded pin to engage or disengage the apertures 64 of the bar 74.

The ball 68 is also shown in the throwing arm 60. A ball of any size, may be placed in the "V" or "U" shaped trough formed by flat sections 33 and angled surfaces 35 (FIG. 5). The throwing arm 60 may provide a smooth surface for ball 68 to rest on which cannot be forced apart during the force of the throw. The throwing arm 60 can thereby accommodate any size of ball 68 for non-limiting example, a wiffle ball, baseball, softball, tennis ball, lacrosse ball, etc. In some embodiments, the throwing arm 60 may be sized to cradle a ball of specific size, for example a baseball, with minimal contact. The throwing arm 60 therefore may have reduced contact with laces or stiches of the ball which improves performance of the throw. Still further the apertures of the throwing arm angled surfaces 35 reduce weight and air resistance, again improving performance.

Figure 5A:
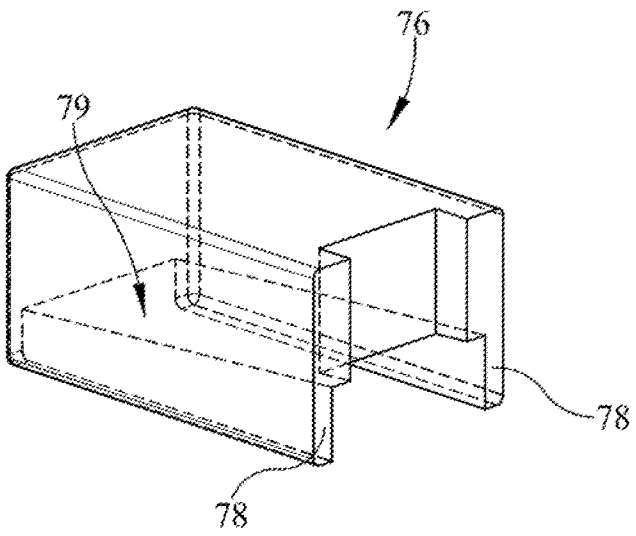
FIG. 5A is a detail view of the release finger which shows the finger removed to reveal interior portions thereof.
Figure 5:
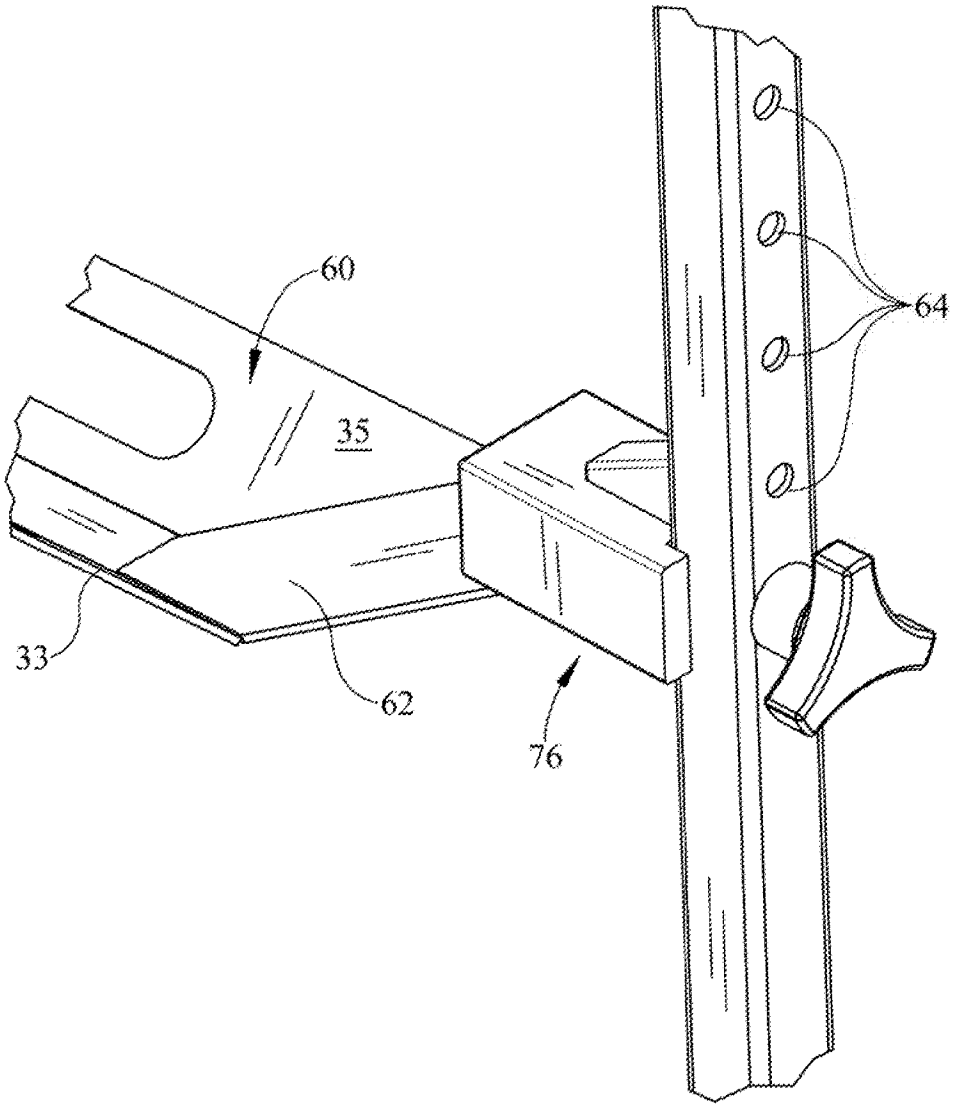
FIG. 5 is a detail view of the release finger.

With reference to FIGS. 5 and 5A, detail views of the release finger 76 is shown. In some embodiments, the lower portion of the release finger 76 is provided with guides 78 that define boundaries for the bottom of the release finger 76 and direct the throwing arm 60 into a desired location of the lower portion of the release finger 76. As also depicted, the interior lower surface 79 of the release finger 76 may be tapered or angled. With the lower engagement surface or edge tapered, vertical movement of the throwing arm 60 is limited or eliminated when the release 70 is pulled.

Referring again to FIGS. 2-3, the throwing arm 60 is pulled rearward far enough so that the release finger 76 can be passed over the top of throwing arm 60. In order to prevent the release of throwing arm 60 in the tensioned cocked position, the user must not release handle 75 but instead must hold it in the forward position towards the front of the base 12. This is necessary although an angled face of release finger 76 may hold the throwing arm in a cocked, ready to throw position. In some embodiments, the throwing apparatus 10 may function so that if a user does not hold release handle 75 in the forward position, thereby holding top of throwing arm 60 in the rearward cocked position, the top of throwing arm 60 will slide relative to the release finger 76 to return throwing arm 60 to throw the ball and return the arm to the uncocked resting position. Throwing apparatus 10 has been designed this way so as to insure that the device may not be left in the cocked, armed position such as illustrated in FIG. 2, where throwing arm 60 has rotated around axle 40 at throwing arm's 60 connection just above the bottom of throwing arm 60. Because spring 56 is connected to the lever 50, this movement of the lever 50 and movement of the leg 54 stretches spring 56 creating potential energy so long as release handle 75 is held in the forward position as previously described. The self-centering ability of throwing apparatus 10 results in throwing apparatus 10 returning to the resting position illustrated in FIG. 1. That is, spring 56 applies tension to the lever 50 in both extremes of motion, rearward and forward, so as to both move and stop throwing arm 60 and return it to the resting position.

Referring again to FIGS. 1 and 2, near the upper end of the release bar 74 is a shield or hand guard 77. The structure may be formed of plastic or metallic materials. The shield 77 inhibits a user from reaching toward the ball when the spring 56 is energized by depressing the foot pedal 55. Also, the shield 77 blocks the ball from hitting a user if by chance the user were to use the device incorrectly forcing the ball in an upward or rearward direction.

Figure 6:
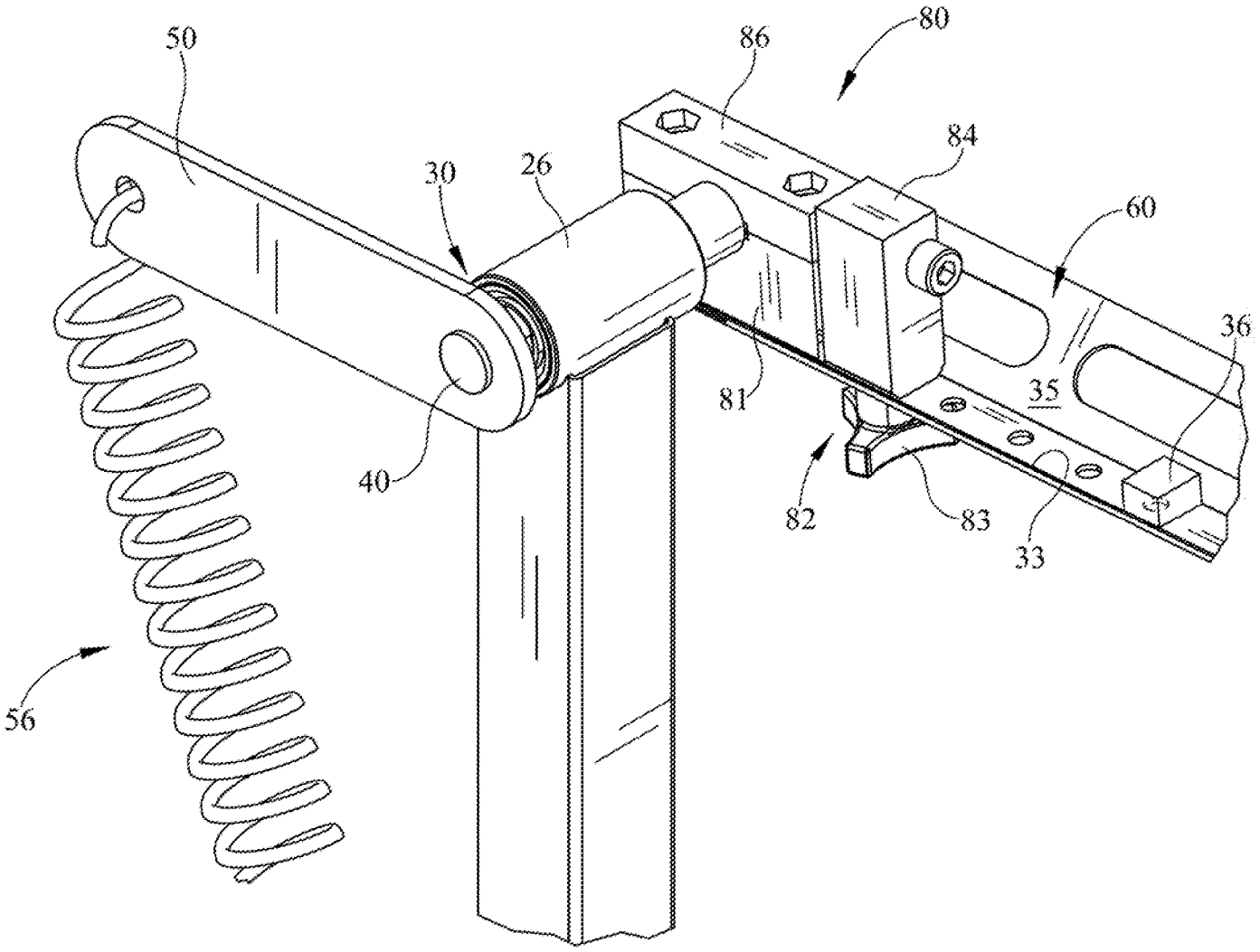
FIG. 6 is a second end of the throwing arm.

Referring now to FIG. 6, a detailed perspective view of the forward end of the throwing arm 60 is provided. A mounting block 80 is provided which receives a rotatable axle 40 extending through the sleeve 26. The axle 40 may be rotatably supported within the sleeve 26 and connected to the axle 40 to move therewith.

Figure 4:
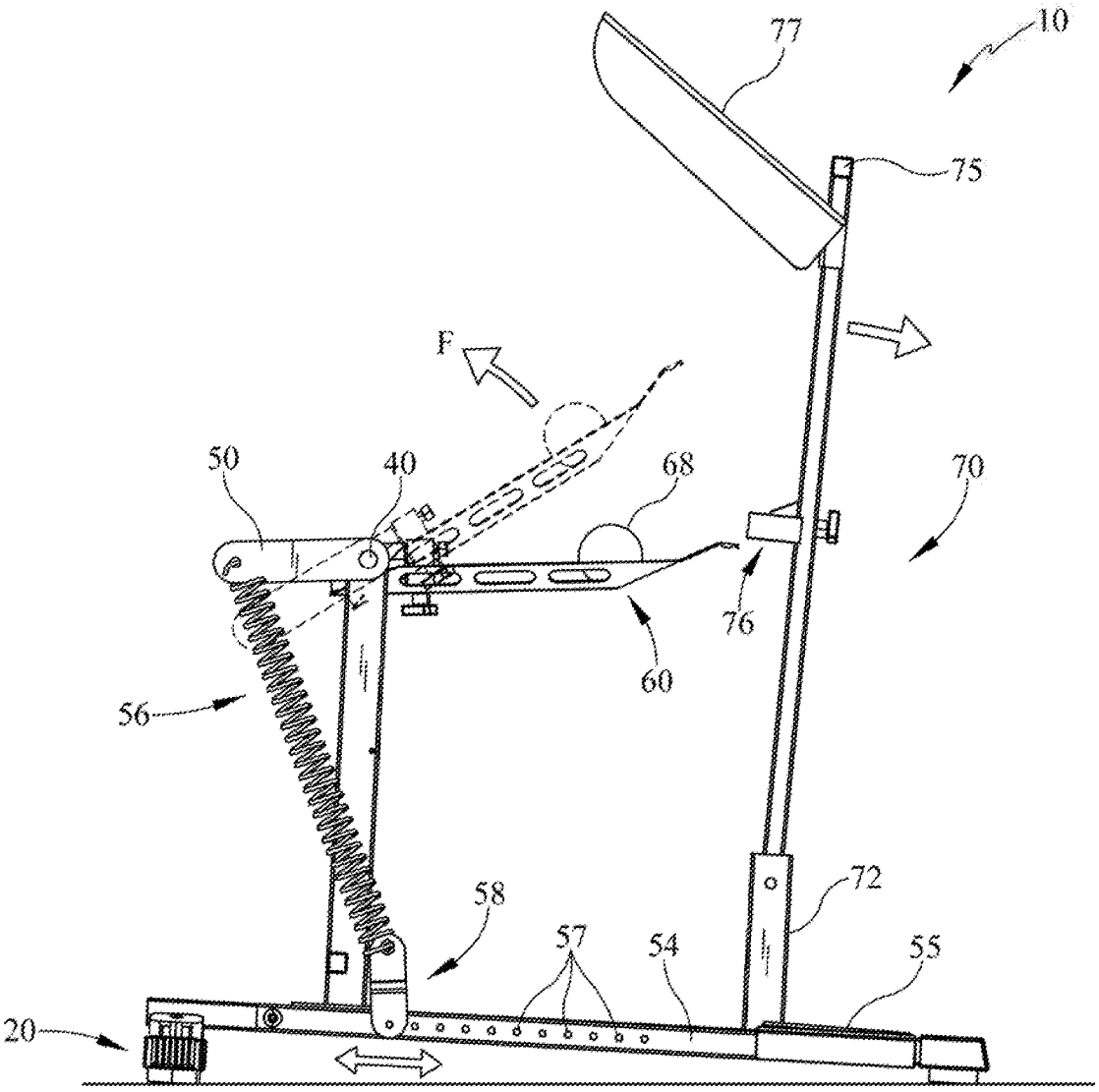
FIG. 4 is a third sequence view of an embodiment of the throwing mechanism shown throwing the ball.

As discussed previously, the axle 40 is rotatably supported and in some embodiments, a bearing assembly 30 may be disposed in the sleeve 26. With the throwing arm lever 50 disposed at the opposite side of the sleeve 26 and acted upon by the spring 56, rotation of the lever 50 causes rotation of the axle 40 and movement of the axle mounting block 80. This allows for pivoting motion of the throwing arm 60 upon disengagement from the release finger 76 (FIG. 4).

The bearing assembly 30 may comprise at least one or, in some embodiments, two bearings disposed within the sleeve 26 which rotatably supports the axle 40. The assembly 30 may also be disclosed within in a housing, all of which is slidably positioned within the sleeve 26.

The mounting block 80 may be connected to the throwing arm 60 and pivots with the axle 40 by clamping to the axle 40. The mounting block 80 may be defined by a first portion 81 and a second portion 86 to capture the axle 40. In such arrangement, the mounting block also defines a fulcrum of the throwing arm 60. Thus when the arm lever 50 turns the axle 40, the mounting block 80 also turns. The mounting block 80 may be formed of one or more structures which connect to the axle 40 and according to some embodiments, the block clamps on to the axle 40. However, other ways of connecting to the axle 40 may be utilized. The throwing arm 60 is also connected to the block 80 so that when the mounting block 80 rotates, the throwing arm 60 also rotates to throw a ball.

Adjacent to the mounting block 80 is a micro adjustment block 84. The micro-adjustment block 84 is movable toward or away from the mounting block 80 in order to make micro height adjustments of the ball flight. A plurality of adjustment apertures are provided along the flat section 33 of the throwing arm 60. The fastener 82 and knob 83 allow for loosening of the micro adjustment block 84 to move along the throwing arm 60. Once the block 84 is moved to a desired position, the fastener 82 may be tightened to lock the block in the desired location. The fastener 82 in some embodiments, may comprise a knob 83 which allows the adjustment of the throwing arm 60 relative to the mounting block 80. The fastener 82 may extend from below, through the throwing arm 60, and to the micro adjustment block 84 to capture the throwing arm 60 therebetween.

Referring now back to FIG. 4, the release bar 74 is moved from its position in FIG. 2, to disengage the throwing arm 60, as shown by the double line arrow. The spring 56 forces rotation of lever 50 from its position in FIG. 3, to its position in FIG. 4. The force of the spring 56 therefore also causes rotation of the axle 40 and the throwing arm 60. The throwing arm 60 is shown moving and the ball 68 as flying from the throwing arm 60 in the forward direction F.

With reference again to both FIGS. 2-4, attention is again returned to the spring 56. The lower end of the spring 56 is connected to the leg 54 in order to energize the spring 56 in combination with the retention of the throwing arm 60 by the release 70. The spring 56 position may also be adjustable relative to the leg 54.

At the lower end of the spring 56, a bracket 58 is provided which is connected to the spring lever 50 and is movably connectable to the leg 54. The bracket 58 includes a fastener or pin to retain, or otherwise connect, the bracket 58 to the leg 54. A plurality of fastener apertures 57 may be disposed in the leg 54 to allow insertion of the fastener therethrough and connect the bracket 58 with the leg 54 at various positions along the axial length of the leg 54. A variety of fasteners, screws, bolts or pins may be utilized which are now known or hereafter developed. Further a push-button structure may be alternatively used to engage or disengage the leg 54.

By moving the bracket 58 along the leg 54, the spring force may be varied. In some embodiments, the bracket 58 may be moved forward on the leg 54 to provide one spring force and alternatively, may be moved rearward to provide a second spring force. Accordingly, by varying the spring force the speed and/or distance thrown by the throwing machine 10 may be adjusted. Further, by varying release point, pitches, fly balls, popups, and other types of simulated hits, for example, may be provided for batting or fielding practice.

Throwing arm 60 may also include an adjuster to support a ball 68 in a plurality of positions along the arm 60. The support 36 may be a block or retainer of any appropriate rigid material such as PVC, aluminum or the like and may also vary in shape.

With reference to FIG. 7, a chart 100 is provided that illustrates various adjustments. In one embodiment, the chart provides an adjustment list for various speeds and distances. The instant embodiment provides for three adjustments: (a) adjustment of the spring 56 position on the leg 54; (b) micro height adjustment of the ball height via adjustment block 84 and, (c) adjustment of finger 76. As depicted in the chart, settings may be provided for a desired speed and/or a desired distance. Likewise, portions of the leg 54, release 70, and throwing arm 60 may be marked with numerical or other indicators corresponding to the values provided in the chart and/or raising or lowering the height of the thrown ball. Charts may be provided for various ball types as well as desired speeds and/or other characteristics.

The method of use of the throwing apparatus 10 of the present invention will now be disclosed with reference to FIGS. 1-7. Initially, the throwing machine 10 may be placed on or near a playing surface, for example a pitching mound if used for batting practice. In operation, once located the appropriate distance from home plate, a stake may be placed through stake hole 25 (FIG. 1) in the cross member 20 and/or in the base 12. Next, the user chooses the pitch that is desired by reference to speed and distance chart 100 in FIG. 7. Once that is determined, a fastener is placed through the bracket 58 and through the appropriate speed adjustment connection location and release finger 76 is placed in one of the appropriate pitch height or macro adjustment holes 64. Again, any means known in the art to make this connection secure is appropriate. Throwing arm 60 is pulled rearward toward the back of base 12 and the top of throwing arm 60 is placed under release finger 76 of release 70 and release handle 75 is moved and held in the forward position towards the front of base 12.

Ball 68 is thrown by pulling release handle 75 rearward towards back of base 12. Once released, throwing arm 60 is rapidly rotated with axle 40 and throws ball 68 across the plate. If necessary, the user adjusts release finger 76 in one direction to raise the pitch and in a second direction to lower the pitch until the ball 68 crosses the plate at the desired height. Still further, the micro adjustment block 84 may be used to make finite movement of the pitch height to the desired location. In this case, movement of micro-vertical adjustment block 84 along the throwing arm 60 using the fastener 82.

While the throwing apparatus 10 of the present embodiments have been disclosed in connection with throwing of a baseball, it should be appreciated that throwing machine 10 can be used in other situations as well. The present invention provides an extraordinarily portable, light weight accurate throwing device which can be easily manipulated in order, for example, to lob tennis balls, volleyballs, softballs, basketballs, lacrosse and any other situation where a consistent repetitive accurately thrown object is desirable.

According to the instant embodiments, the throwing apparatus 10 may include various adjustment positions 57 along the leg 54, various macro pitch height adjustment holes 64 on the release 70 and various micro adjustments along the throwing arm 60. The various adjustments allow for numerous possibilities for ball height, from pop ups to ground balls, at various speeds and at various distances. Additionally, the apparatus meets the long felt need of a highly efficient device which does not require power at a use location of, for example, a playing field, but also provides improved performance over prior art throwing devices. Present embodiments also provide that only minimal testing by persons of ordinary skill in the art may be necessary in order to achieve the appropriate ball speeds and heights. Certainly various speeds, higher or lower, than these may be accomplished by simple design choices of the materials to be used.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A throwing apparatus, comprising:

a base having a forward end and a rearward end;

a transverse support cross-member extending across said base;

an axle arm mount extending from said base, a sleeve disposed on said axle arm mount;

a throwing arm lever disposed along one side of said axle arm mount;

a throwing arm disposed on a second side of said axle arm mount;

a bearing assembly disposed in said sleeve, an axle extending through said sleeve and supported by said bearing assembly, said axle operably connected to said throwing arm lever and said throwing arm; and, said one side being toward one end of said axle and said second side being toward a second end of said axle, so that said throwing arm and said throwing arm lever are offset;

a spring extending from said throwing arm lever to a movable leg, wherein the moveable leg, the spring and the throwing arm lever are all located on one side of the base.

2. The throwing apparatus of claim 1, said moveable leg being pivotally connected to said base.

3. The throwing apparatus of claim 1, wherein one end of said spring is adjustable relative to said moveable leg.

4. The throwing apparatus of claim 1, said base comprising a foot at one end of said base.

5. The throwing apparatus of claim 1, further comprising a mounting block operably connected to said throwing arm.

6. The throwing apparatus of claim 5, said mounting block operably connected to said axle.

7. The throwing apparatus of claim 1, said throwing arm having a first surface and a second surface angled relative to the first surface.

8. The throwing apparatus of claim 7, said throwing arm having a plurality of adjustment apertures.

9. The throwing apparatus of claim 1, further comprising a release arm having a handle.

10. The throwing apparatus of claim 9, said release arm having a release finger with control guides.

11. The throwing apparatus of claim 10, further comprising an angled surface disposed between said control guides.

12. The throwing apparatus of claim 1, said leg comprising a foot pedal at an end thereof.

13. A throwing apparatus, comprising:

a base having a forward end and a rearward end;

a transverse cross-member at one of said forward end or said rearward end extending across said base;

an axle arm mount extending above said base;

a throwing arm lever disposed along one side of said axle arm mount;

a throwing arm disposed on a second side of said axle arm mount;

a sleeve disposed on said axle arm mount and oriented horizontally, a bearing assembly disposed in said sleeve, an axle extending through said sleeve and supported within said sleeve by the bearing assembly, said axle operably connected to said throwing arm lever and said throwing arm wherein said throwing arm lever and said throwing arm are disposed near opposed ends of said axle;

a spring extending from said throwing arm lever to a movable leg, said moveable leg pivotally connected to said base, said spring, said throwing arm lever, and said moveable leg disposed on one side of said base; and, a release which retains or releases said throwing arm from a cocked position to throw a ball.

14. A throwing apparatus, comprising:

a base having a forward end and a rearward end;

a cross-member at one of said forward end or said rearward end extending across said base;

a sleeve elevated from said base and positioned on an axle arm mount extending above said base, said sleeve oriented horizontally;

an axle extending through said sleeve and supported by a bearing assembly within said sleeve, said axle operably connected to a throwing arm lever near one end of said axle and a throwing arm near a second end of said axle, spaced from said throwing arm lever;

a spring extending from said throwing arm lever to a movable leg, said moveable leg pivotally connected to said base to energize said spring;

said spring, said moveable leg and said throwing arm lever all located on one side of said base;

a release which retains or releases said throwing arm from a cocked position to throw a ball.

* * * * *